US005823246A

United States Patent [19]

Lauener

[11] Patent Number: 5,823,246

[45] Date of Patent: Oct. 20, 1998

[54] TUNDISH INCLUDING A BAFFLE FOR DIRECTING MOLTEN METAL THERETHROUGH AND AN ASSOCIATED CASTER AND METHOD OF CASTING MOLTEN METAL

[75] Inventor: Wilhelm F. Lauener, Gerlafingen/SO, Switzerland

[73] Assignee: Larex A.G., Solothurn, Switzerland

[21] Appl. No.: 808,465

[22] Filed: Mar. 3, 1997

[51] Int. Cl.[6] ..... B22D 11/10; B22D 41/00

[52] U.S. Cl. ..... 164/488; 164/437; 222/606

[58] Field of Search ..... 164/437, 488, 164/480, 481, 428, 431, 432; 222/594, 606, 607

[56] References Cited

U.S. PATENT DOCUMENTS 4,485,835 12/1984 Huber et al. .
4,550,766 11/1985 Ai et al. .
4,550,767 11/1985 Yu et al. .
4,619,309 10/1986 Huber et al. .
4,785,873 11/1988 Lauener .
4,794,978 1/1989 Lauener .
4,798,315 1/1989 Lauener .
4,964,456 10/1990 Lauener .
5,221,511 6/1993 Fukase et al. ..... 222/594

*Primary Examiner*—Kuang Y. Lin
*Attorney, Agent, or Firm*—David V. Radack; David W. Brownlee; Eckert Seamans Cherin & Mellott, LLC

[57] ABSTRACT

A tundish including a baffle for directing the flow of molten metal through the tundish. The caster of the invention includes a mold having a center portion and an outside edge portion for solidifying molten metal into a metal product. The caster includes a tundish having a baffle for directing the flow of the molten metal into the mold so that the molten metal solidifies in the central portion before solidifying in the outside edge portion. This way, cracking of the metal product which is solidified in the mold is resisted. An associated method of casting molten metal into a metal product in a mold of a caster is also provided.

5 Claims, 5 Drawing Sheets

TUNDISH INCLUDING A BAFFLE FOR DIRECTING MOLTEN METAL THERETHROUGH AND AN ASSOCIATED CASTER AND METHOD OF CASTING MOLTEN METAL

BACKGROUND OF THE INVENTION

This invention relates to a tundish including a baffle for directing molten metal therethrough and an associated caster and method of casting molten metal.

Casters for casting molten metal, such as molten aluminum, into metal products are known. Molten metal is typically introduced into the caster from a holding furnace that is operatively associated with a trough. Molten metal in the trough is then delivered into a tundish and thereafter to a nozzle. The nozzle, finally, introduces the molten metal into the mold of the caster. In a twin belt caster, the mold is formed by a pair of opposed movable belts and a pair of opposed side dams. A metal product, such as a slab, is formed in the mold by solidifying the molten metal. An example of a twin belt caster is described in U.S. Pat. No. 4,964,456.

The tundish and nozzle construction and arrangement are crucial for the formation of a commercially acceptable metal product. Ideally, the molten metal should be introduced into the mold in a laminar, quiescent state. Additionally, the molten metal should be introduced into the mold so that residual stresses in the solidifying metal product are handled in order to avoid undesired cracking of the slab. U.S. Pat. No. 4,798,315 teaches a molten metal delivery apparatus that attempts to meet these needs. While this arrangement has been found to be effective, there is still a need to provide improvements in the way the molten metal is directed through the tundish and introduced into the nozzle so that a superior metal product is produced by the caster.

SUMMARY OF THE INVENTION

The invention has met or exceeded the above-mentioned needs as well as others. The tundish of the invention includes a baffle for directing the flow of molten metal through the tundish. The caster of the invention includes a mold having a center portion and an outside edge portion for solidifying molten metal into a metal product. The caster includes a tundish having a baffle for directing the flow of the molten metal into the mold so that cracking of the metal product which is solidified in the mold is resisted.

An associated method of casting molten metal into a metal product in a mold of a caster is also provided. The method comprises introducing the molten metal into a tundish including a baffle and directing the molten metal through the tundish by means of the baffle into the mold. After this, the molten metal is solidified in the mold such that the molten metal solidifies in such a way so as to resist cracking of the metal product.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

Figure 1:
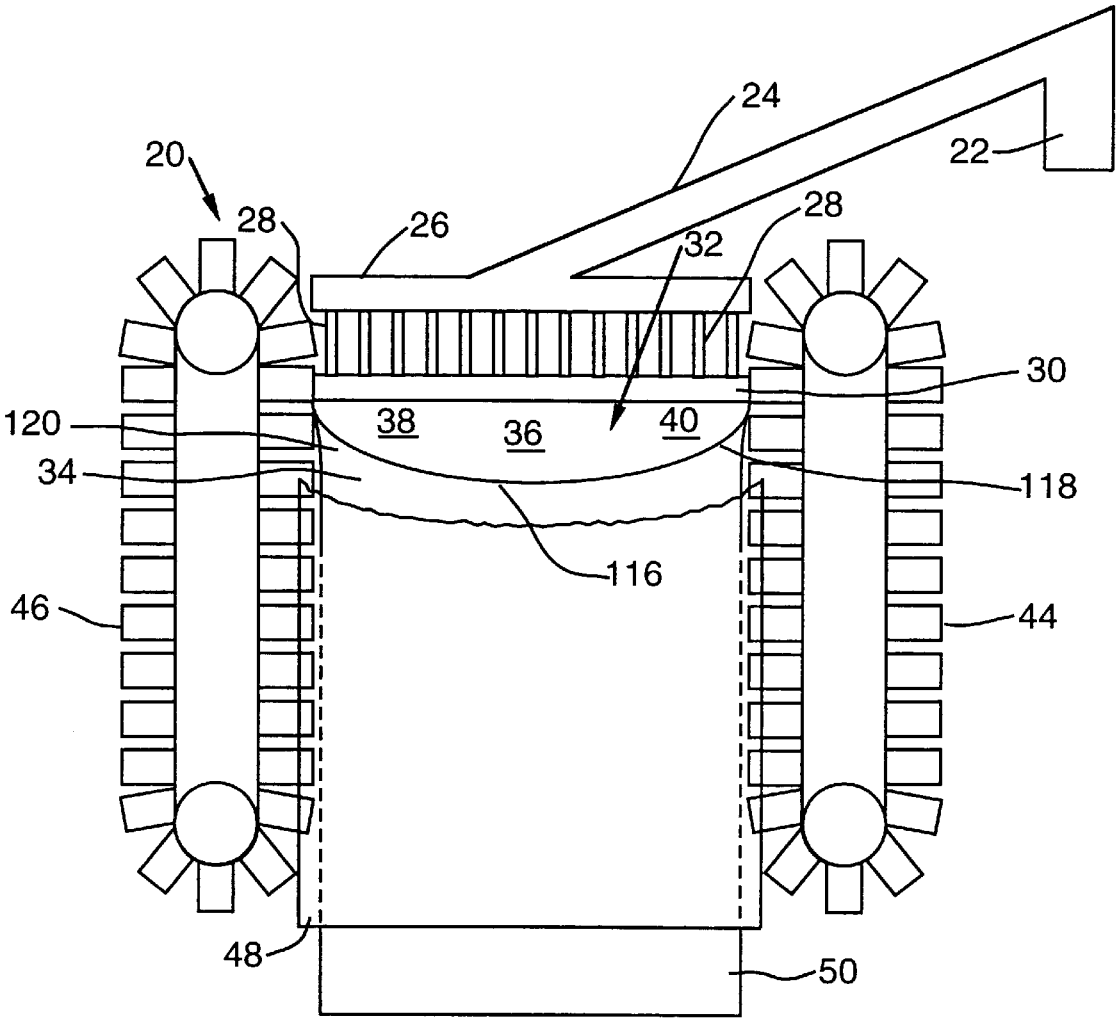
FIG. 1 is a partially schematic and partially cutaway elevational view of a twin belt caster.
Figure 2:
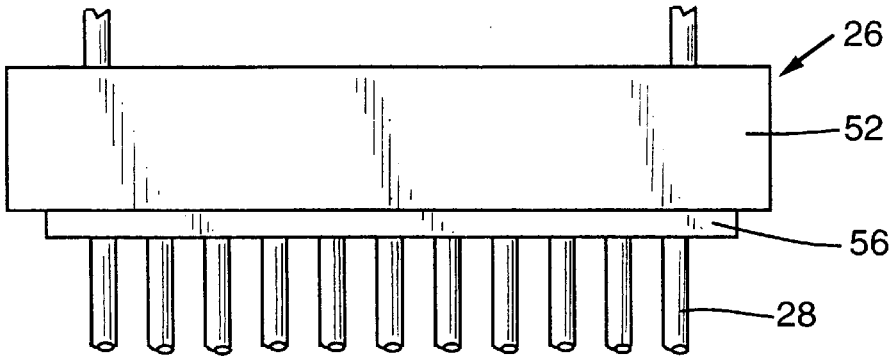
FIG. 2 is a front elevational view of the tundish of the invention.

Referring now particularly to FIG. 1, a partially schematic and partially cutaway elevational view of a twin belt caster 20 is shown. The caster 20 is supplied with molten metal from a holding furnace 22. The molten metal is delivered from the holding furnace 22 by a trough 24 to the tundish 26 of the caster 20. The molten metal then is directed by the tundish 26 of the invention (described in detail below) into a plurality of tubes 28 and then into the nozzle 30. The nozzle 30 introduces the molten metal 32 into the mold 34 of the caster 20. The mold 34 includes a center portion 36 and, because this mold 34 is generally rectangular in cross-section in order to form slabs, a pair of outside edge portions 38 and 40. The mold 34 is defined by a pair of opposed movable side dams 44 and 46 and a pair of opposed movable belts, only one of which, belt 48, can be seen in FIG. 1. It will be appreciated that the side dams can be stationary. The molten metal 32 solidifies into a metal product 50 in the mold 34 and is then moved out of the mold 34 at casting speed.

For a more detailed description of a twin belt caster, reference is made to U.S. Pat. No. 4,964,456. For a more detailed description of the tundish 26, tubes 28 and nozzle 30 reference is made to U.S. Pat. No. 4,798,315. Finally, for a more detailed description of the movable side dams 44 and 46, reference is made to U.S. Pat. No. 4,794,978. All of the above three United States Patents are expressly incorporated by reference herein.

Figure 3:
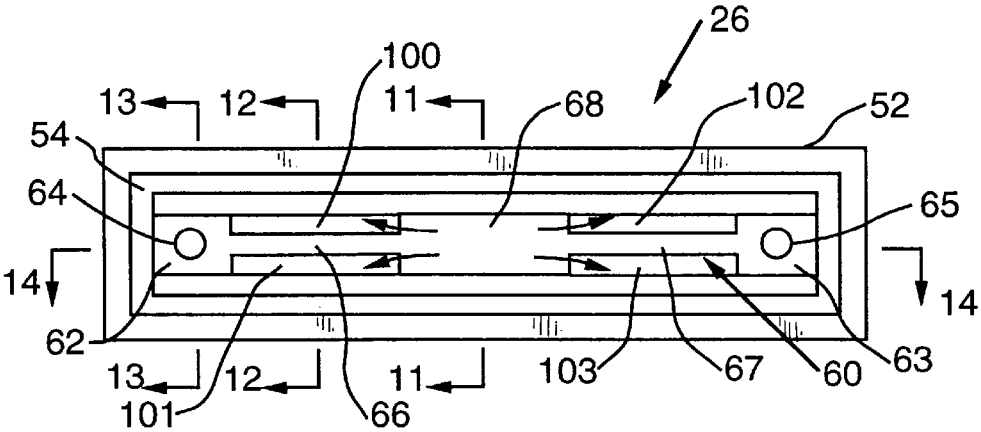
FIG. 3 is a top plan view of the tundish shown in FIG. 2.
Figure 4:
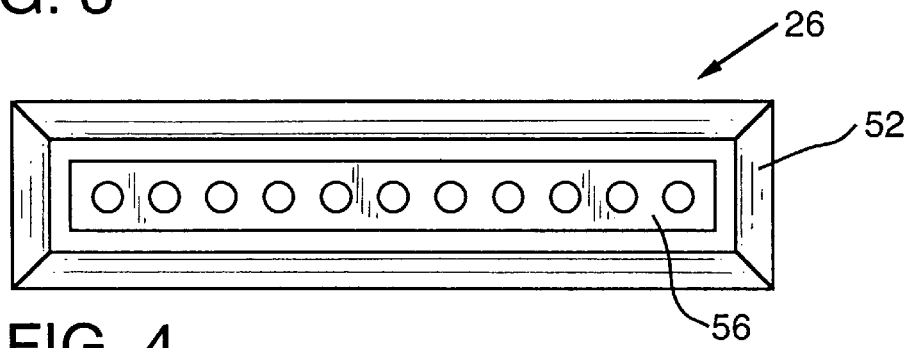
FIG. 4 is a bottom plan view of the tundish shown in FIG. 2.
Figure 5:
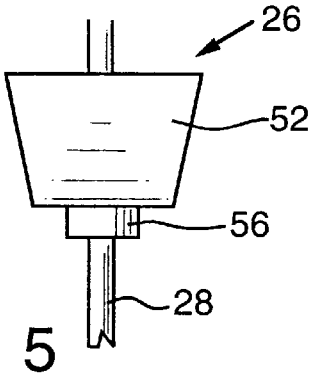
FIG. 5 is a side elevational view of the tundish shown in FIG. 2.
Figure 6:
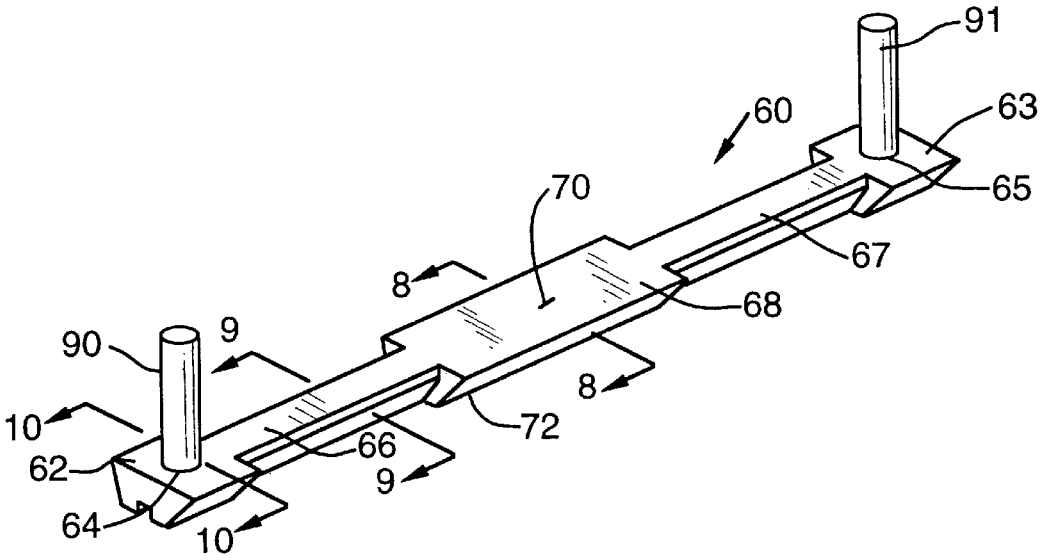
FIG. 6 is a perspective view of the baffle of the invention.

Referring now to FIGS. 2–5, the tundish 26 of the invention is shown in more detail. The tundish 26 includes an outer metal casing 52 and a refractory liner 54 (FIG. 3). A tundish plate 56 is used to connect the tubes 28 to the tundish 26. In accordance with the invention, a baffle 60 is disposed in molten metal reservoir area defined by the tundish 26. As will be explained further hereinbelow, the baffle 60 directs the molten metal delivered therein through the tundish 26 and into the tubes 28 for subsequent delivery to the nozzle 30 and ultimately to the mold 34 of the caster 20.

Figure 7:
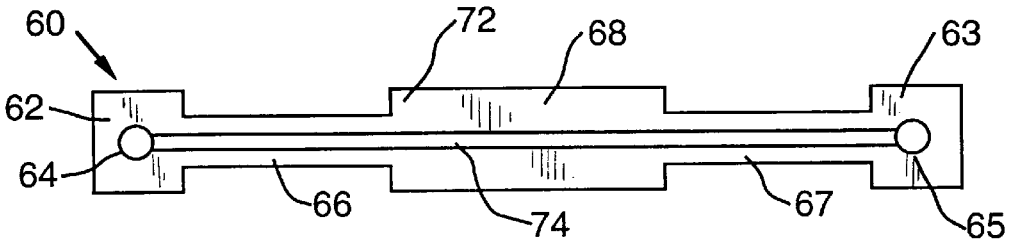
FIG. 7 is a bottom plan view of the baffle of the invention.
Figure 8:
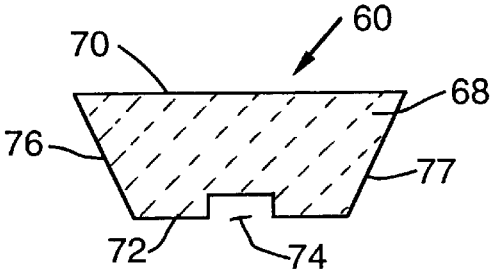
FIG. 8 is a cross-sectional view taken along line 8—8 of FIG. 6.
Figure 9:
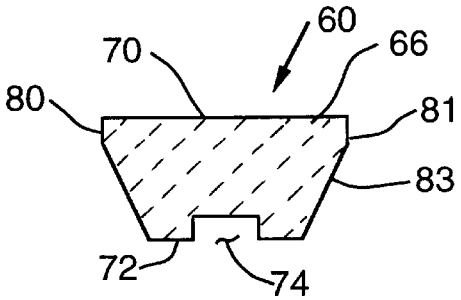
FIG. 9 is a cross-sectional view taken along line 9—9 of FIG. 6.

As mentioned above, the baffle 60 directs the molten metal introduced into the tundish 26 in a desired fashion. Referring now to FIGS. 6–9, the baffle 60 is shown removed from the tundish 26. The baffle 60 is made from a refractory material. An example of a suitable refractory material is sold under the trade name Insulit-HT by Insultech AG in Switzerland. The baffle 60 is constructed and sized to be friction-fit into the tundish 26, although with some embodiments of the baffle 60, the baffle 60 may need to be attached by mechanical means or by adhesives. Preferably, however, no separate attachment means, such as screws or adhesives, are needed to support the baffle 60 in the tundish 26. The baffle 60 includes a pair of end sections 62, 63 which define respective openings 64, 65; a pair of thin intermediate sections 66, 67 and a central section 68. The baffle 60 includes an upper surface 70 on which molten metal is poured from the trough to the tundish 26. Referring to FIGS. 7–9, the baffle 60 also includes an undersurface 72 which defines a longitudinal groove 74 running from opening 64 to opening 65. The purpose of the groove 74 and openings 64, 65 will be explained in detail below.

Referring to FIG. 8, the central section 68 has a pair of opposed angled sidewalls 76 and 77. These angled sidewalls 76 and 77 are contoured to the angled sidewalls of the liner 54 of the tundish 26 so that the baffle 60 can be friction-fit into the tundish 26. FIG. 9 shows a cross-sectional view of the thin intermediate section 66. This section 66 includes opposed straight sidewall portions 80, 81 and opposed angled sidewall portions 82, 83. As will be explained below, these sidewall portions 80, 82 and 81, 83 define, along with the refractory tundish liner 54 a passageway for flow of molten metal. The groove 74 can also be seen in the undersurface 72 of the intermediate section 66 in FIG. 9.

Figure 10:
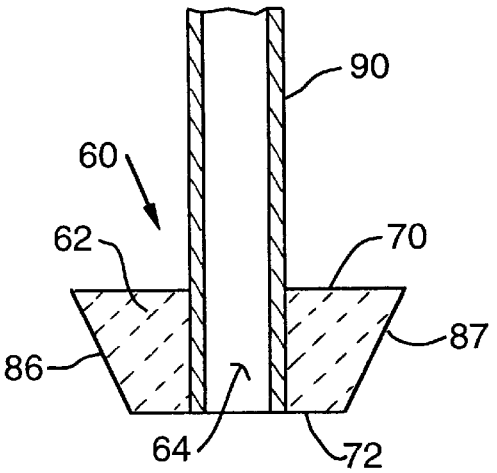
FIG. 10 is a cross-sectional view taken along line 10—10 of FIG. 6.

FIG. 10 shows a cross-sectional view of end portion 62. End portion 62 has opposed angled sidewalls 86, 87 which, like sidewalls 76, 77, are contoured to the angled sidewalls of the refractory liner 54 of the tundish 26. FIG. 10, along with FIG. 6, also show another aspect of the invention which are chimneys 90 and 91 disposed and supported in openings 64 and 65 respectively. These chimneys 90 and 91 are made of the same materials as the baffle 60 and their purpose, as will be explained in further detail below, is to vent gases that come up from the mold 34, the nozzle 30 and the tubes 28 and which collect in the groove 74 from the tundish 26 and then vent these to the atmosphere. The chimneys 90 and 91 also provide a means for preheating the tundish 26, tubes 28 and nozzle 30 before hot molten metal is introduced therein. This is accomplished by blowing hot air into the top of the chimneys 90 and 91 and forcing the hot air into the tundish 26, tubes 28 and nozzle 30.

Figure 11:
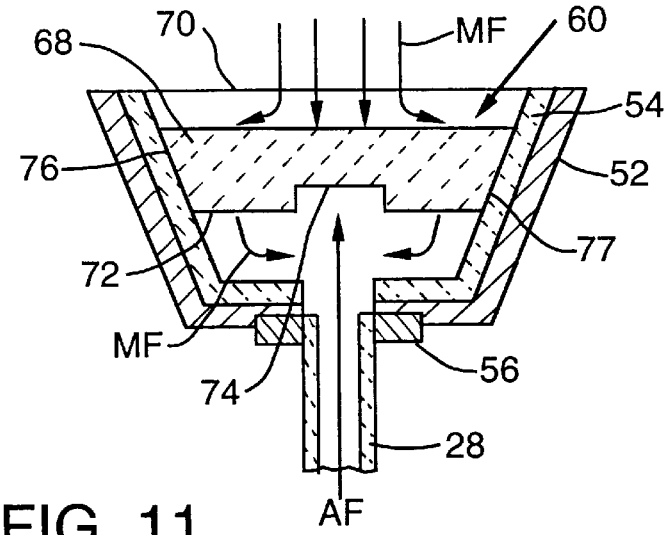
FIG. 11 is a cross-sectional view taken along line 11—11 of FIG. 3.
Figure 12:
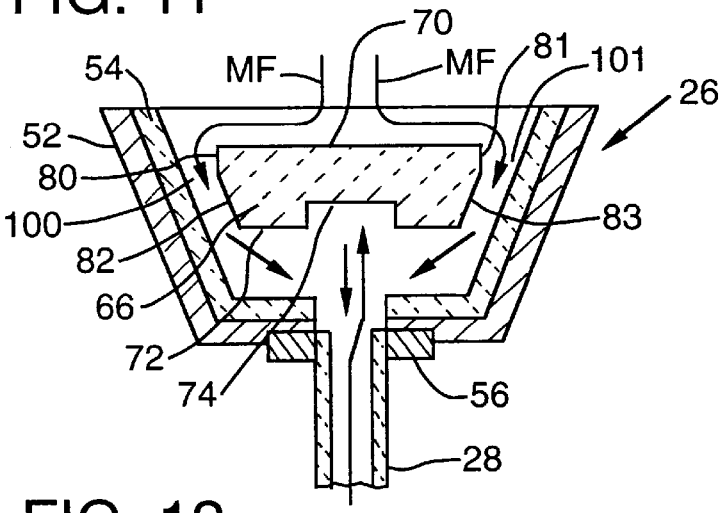
FIG. 12 is a cross-sectional view taken along line 12—12 of FIG. 3.
Figure 13:
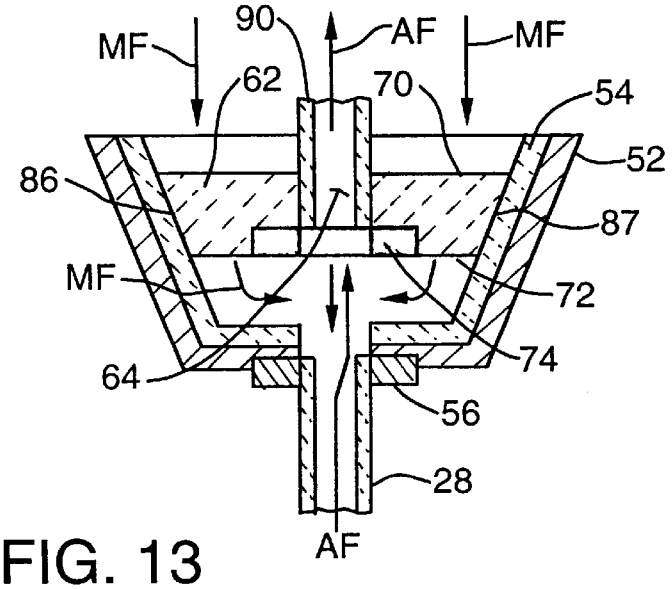
FIG. 13 is a cross-sectional view taken along line 13—13 of FIG. 3.
Figure 14:
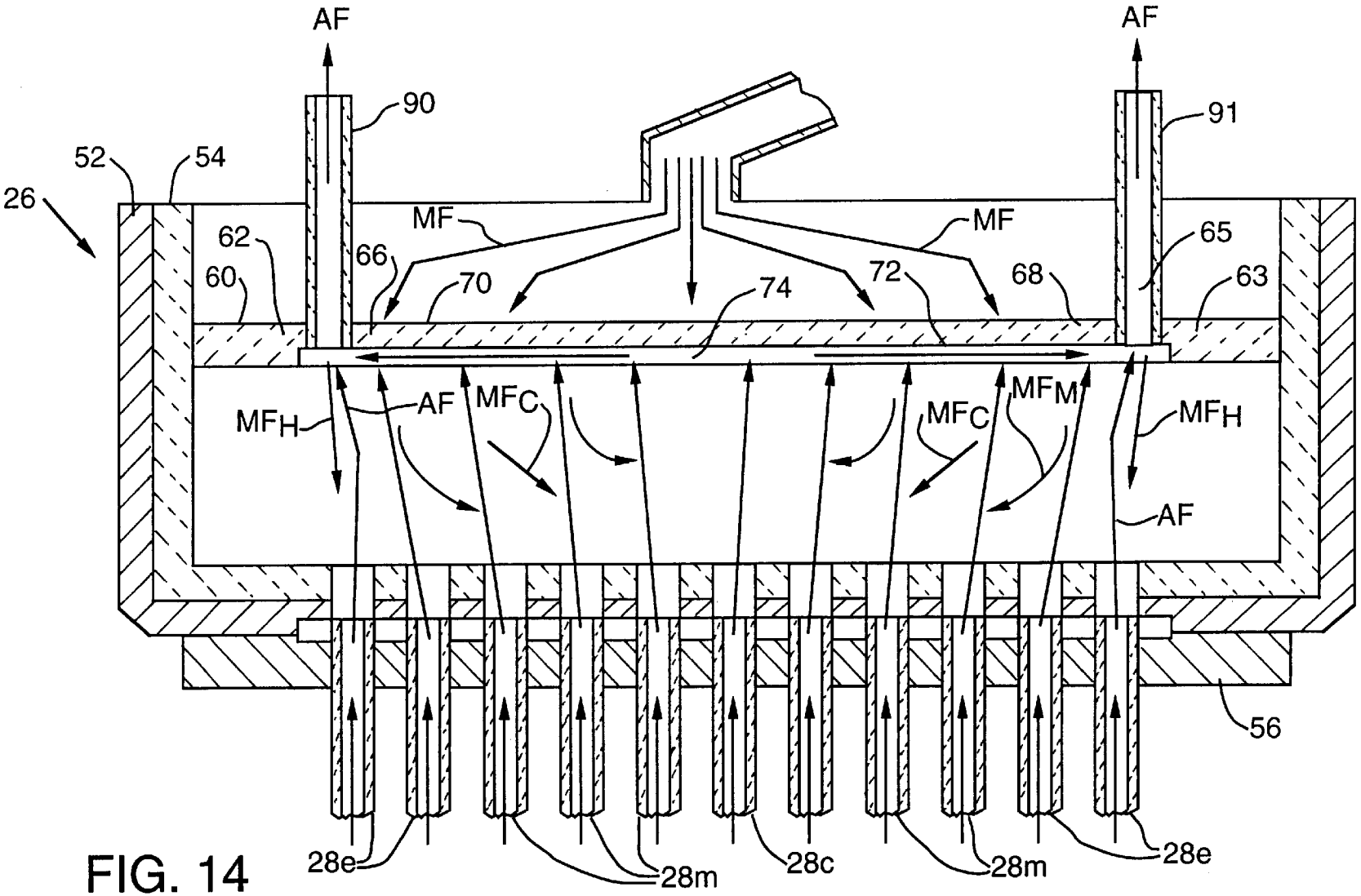
FIG. 14 is a cross-sectional view taken along line 14—14 of FIG. 3.

Referring now to FIGS. 3 and 11–14, the baffle 60 is shown in position in the tundish 26. As can be seen in FIGS. 3, 11 and 13, the sidewall portions 76, 77 of central section 68 and the sidewall portions 86, 87 of end section 62 are friction-fit against the liner 54 of the tundish 26. As can be seen in FIGS. 3, 12 and 14 the sidewall portions 80, 81 and 82, 83 of intermediate section 66 and the liner 54 define passageways 100, 101. Referring back to FIG. 3, similar passageways 102, 103 are formed by intermediate section 67. This arrangement causes molten metal flow, indicated by the letters "MF", to strike the upper surface 70 of the baffle 60 and diverge outwardly therefrom to flow through passageways 100, 101, 102, 103. As can best be seen in FIGS. 3 and 14, the hottest molten metal ($MF_H$) (because it has spent the least time from the period measured by the time it takes to get through the tundish 26 into the mold 34) will be delivered to the outermost tubes **28*e* and the outermost portion of the nozzle 30 for subsequent delivery to the outside edge portions 38 and 40 (FIG. 1) of the mold 34. The next hottest molten metal ($MF_M$) will be delivered to the tubes 28*m* between the outermost tubes 28*e* and the central tubes and then to the portions of the nozzle 30 between the outer edge and central portion thereof for subsequent delivery closer to the central portion 36 of the mold 34 with the least hottest metal ($MF_C$) being delivered to the central tubes 28*c* and then to the center of the nozzle 30 and finally to the center 36 of the mold 34 itself. In this way, solidification of the metal product 50 occurs while resisting cracking of the metal product 50**.

Another aspect of the invention is shown in FIGS. 11–14 and that is the air flow, indicated by the letters "AF", from the mold, nozzle, tubes and tundish, through the baffle 60 and out of the chimneys 90, 91. As can be seen in these figures, air from air flow "AF" collects in groove 74 and is moved through groove 74 to openings 64 and 65 and vents out from chimneys 90, 91 into the atmosphere. As can be appreciated, the groove 74 and chimneys 90, 91 provide a separate pathway for air flow "AF" than the passageways 100–101 for metal flow "MF". This is especially important at the start of the cast, in order to exacuate the air from the nozzle out into the atmosphere. As the cast progresses, less and less air flow is exacuated through the chimneys and thus the need for venting is reduced.

It will be appreciated that a tundish including a baffle has been provided which not only directs molten metal flow to resist cracking of the slab, but which also provides a separate pathway for the flow of air from out of the caster.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A tundish through which molten metal is cast downwardly to form a cast rectangular product, said tundish including a generally rectangular baffle in it with said baffle having a longitudinal axis and comprising a central portion, a pair of end sections on opposite ends of the baffle along said longitudinal axis, and intermediate sections between said central portion and said end sections for creating two spaced passageways in said tundish so molten metal introduced into said tundish will diverge around said central portion along the longitudinal axis of said baffle and will flow downwardly through said passageways to be cast into a cast product with reduced cracking of metal in the cast product, said baffle further having at least one vertical opening therethrough and a chimney on the baffle over the opening for gasses to flow from said molten metal in said mold, below the baffle, upwardly through said opening and said chimney.

2. The tundish of claim 1, including a chimney operatively associated with each said opening.

3. The tundish of claim 1, wherein said baffle includes (i) a first surface onto which said molten metal is introduced and (ii) an opposed undersurface; and said undersurface defines a groove to facilitate venting of gases from said tundish through said opening and out of said tundish.

4. A method of casting molten metal into a metal product in a mold of a caster, said mold having an elongated rectangular cross-section with a center portion and an outside edge portion, said mold including a tundish that includes a baffle having a generally rectangular configuration with a longitudinal axis, at least one vertical opening through said baffle and a chimney on the baffle over said opening, said method comprising:

introducing hot air downwardly into said chimney and through said baffle to preheat said caster before casting molten metal in it;

thereafter directing molten metal into said tundish and diverting substantially all of the molten metal in opposite directions along said longitudinal axis of said baffle and then downwardly into said mold; and solidifying said molten metal in said mold such that cracking of said metal product is inhibited.

5. The method of claim 4, including casting molten aluminum in said caster.

* * * * *